US007175401B2

(12) United States Patent
Cho et al.

(10) Patent No.: US 7,175,401 B2
(45) Date of Patent: Feb. 13, 2007

(54) VARIABLE CAPACITY ROTARY COMPRESSOR

(75) Inventors: Sung Hea Cho, Suwon-Si (KR); Seung Kap Lee, Suwon-Si (KR); Chun Mo Sung, Hwasung-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 293 days.

(21) Appl. No.: 11/006,540

(22) Filed: Dec. 8, 2004

(65) Prior Publication Data

US 2005/0207925 A1 Sep. 22, 2005

(30) Foreign Application Priority Data

Mar. 17, 2004 (KR) ..... 10-2004-0017929

(51) Int. Cl.
*F04B 49/00* (2006.01)

(52) U.S. Cl. ..... 418/29; 418/60

(58) Field of Classification Search ..... 418/23, 418/29, 60, 63, 178; 417/218, 221, 223, 417/410.3

See application file for complete search history.

(56) References Cited

U.S. PATENT DOCUMENTS 4,416,573 A * 11/1983 Matalis et al. ..... 411/378
5,242,280 A * 9/1993 Fujio ..... 418/11
5,802,896 A * 9/1998 Tsai ..... 70/417
5,871,342 A 2/1999 Harte et al.
7,070,395 B2 * 7/2006 Lee et al. ..... 417/218

FOREIGN PATENT DOCUMENTS

JP 07333703 * 12/1995

* cited by examiner

*Primary Examiner*—Hoang Nguyen
(74) *Attorney, Agent, or Firm*—Staas & Halsey LLP

(57) ABSTRACT

A rotary compressor including upper and lower compression chambers having different interior capacities thereof, a rotating shaft having a locking hole, upper and lower eccentric cams provided on the rotating shaft to be eccentric from the rotating shaft, upper and lower eccentric bushes fitted over the upper and lower eccentric cams, respectively, and a locking pin inserted into the locking hole to change a position of the upper or lower eccentric bush to a maximum eccentric position. A slot is provided at a position between the upper and lower eccentric bushes. Further, a surface-treated part is provided around the locking hole to increase an hardness thereof, thus preventing the surrounding of the locking hole from being worn out when the locking pin collides with a first end or a second end of the slot.

17 Claims, 7 Drawing Sheets

VARIABLE CAPACITY ROTARY COMPRESSOR

CROSS-REFERENCE TO RELATED APPLICATIONS

This application claims the benefit of Korean Patent Application No. 2004-17929, filed Mar. 17, 2004 in the Korean Intellectual Property Office, the disclosure of which is incorporated herein by reference.

BACKGROUND OF THE INVENTION

1. Field of the Invention

The present invention relates, in general, to rotary compressors and, more particularly, to a rotary compressor, which is constructed so that a compression operation is executed in either of two compression chambers having different capacities thereof, by an eccentric unit mounted to a rotating shaft, thus varying a compression capacity as desired.

2. Description of the Related Art

Generally, a compressor is installed in refrigeration systems, such as air conditioners and refrigerators, which operate to cool air in a given space using a refrigeration cycle. In refrigeration systems, the compressor operates to compress a refrigerant which circulates through a refrigeration circuit of the refrigeration system. A cooling capacity of the refrigeration system is determined according to a compression capacity of the compressor. Thus, when the compressor is constructed to vary the compression capacity thereof as desired, the refrigeration system may operate under an optimum condition, according to a difference between an environmental temperature and a preset reference temperature, thus allowing air in the given space to be efficiently cooled, and saving energy.

One variant of the conventional compressor is a rotary compressor. The rotary compressors include a hermetic casing, with a stator and a rotor being installed in the hermetic casing. A rotating shaft penetrates through the rotor. An eccentric cam is integrally provided on an outer surface of the rotating shaft. A roller is provided in a compression chamber to be fitted over the eccentric cam. The rotary compressor constructed as described above is operated as follows. As the rotating shaft rotates, the eccentric cam and the roller execute eccentric rotation in the compression chamber. At this time, a gas refrigerant is drawn into the compression chamber and then compressed, prior to discharging the compressed refrigerant to an outside of the hermetic casing.

However, the conventional rotary compressor has a problem in that the rotary compressor is fixed in a compression capacity thereof, so that it is impossible to vary the compression capacity according to a difference between an environmental temperature and a preset reference temperature.

More specifically, when the environmental temperature is considerably higher than the preset reference temperature, the compressor must be operated in a large capacity compression mode to rapidly lower the environmental temperature. Meanwhile, when the difference between the environmental temperature and the preset reference temperature is not large, the compressor must be operated in a small capacity compression mode so as to save energy. However, it is impossible to change the capacity of the rotary compressor according to the difference between the environmental temperature and the preset reference temperature, so that the conventional rotary compressor does not efficiently cope with a variance in temperature, thus leading to a waste of energy.

SUMMARY OF THE INVENTION

Accordingly, an aspect of the present invention provides a rotary compressor which is constructed so that a compression operation is executed in either of two compression chambers having different capacities by an eccentric unit mounted to a rotating shaft, thus varying a compression capacity as desired.

Another aspect of the present invention provides a variable capacity rotary compressor which is constructed to prevent a surrounding of a locking hole of a rotating shaft from being worn out, when a locking pin inserted into the locking hole repetitively comes into contact with opposite ends of a slot, thus preventing noise from being generate during an operation of the variable capacity rotary compressor, and preventing the locking pin from being broken.

The above and/or other aspects are achieved by providing a variable capacity rotary compressor, including upper and lower compression chambers, a rotating shaft, upper and lower eccentric cams, upper and lower eccentric bushes, a slot, a locking pin, and a surface-treated part. The upper and lower compression chambers have different interior capacities thereof. The rotating shaft passes through the upper and lower compression chambers. A locking hole is provided at a predetermined portion of the rotating shaft. The upper and lower eccentric cams are provided on the rotating shaft. The upper and lower eccentric bushes are fitted over the upper and lower eccentric cams, respectively. The slot is provided at a predetermined position between the upper and lower eccentric bushes. The locking pin is inserted into the locking hole to project from the rotating shaft, and changes a position of the upper or lower eccentric bush to a maximum eccentric position, in cooperation with the slot. The surface-treated part is provided around the locking hole to prevent the locking hole from being deformed or worn out when the locking pin collides with first and second ends of the slot.

The surface-treated part may be provided through a high-frequency heat treatment.

The surface-treated part may be fabricated to have a Rockwell Hardness of 20 or higher.

The locking pin may include a threaded shank, and a head having a larger diameter than the threaded shank. Further, the locking hole may include a first diameter part which has a diameter to correspond to the head, and a second diameter part which has a diameter to correspond to the threaded shank, and has a threaded part to engage with the threaded shank.

The locking hole may be provided at a position between the upper and lower eccentric cams which are eccentric from the rotating shaft in a common direction, so that the locking hole is angularly spaced apart from a maximum eccentric part of each of the upper and lower eccentric cams at about 90°.

The variable capacity rotary compressor may further include a connecting part integrally connecting the upper and lower eccentric bushes, which are eccentric from the rotating shaft in opposite directions to each other. The locking pin may project from the rotating shaft between the upper and lower eccentric cams which are eccentric from the rotating shaft in a common direction, and the slot may be formed around the connecting part to engage with the locking pin.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
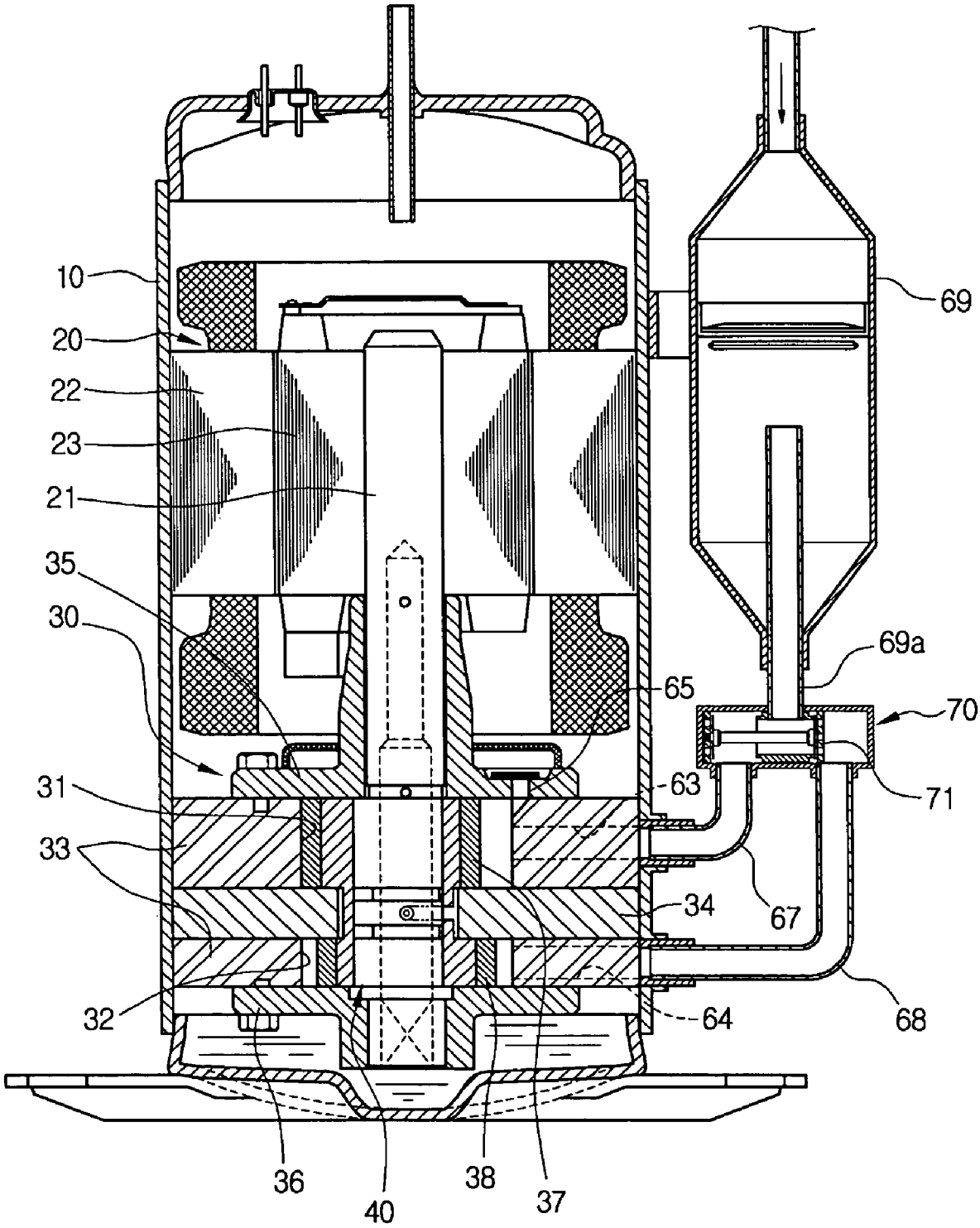
FIG. 1 is a sectional view showing an interior construction of a variable capacity rotary compressor, according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

FIG. 1 is a sectional view showing a variable capacity rotary compressor, according to an embodiment of the present invention. As illustrated in FIG. 1, the variable capacity rotary compressor includes a hermetic casing 10, with a drive unit 20 and a compressing unit 30 being installed in the hermetic casing 10. The drive unit 20 generates a rotating force, and the compressing unit 30 compresses gas using the rotating force of the drive unit 20. The drive unit 20 includes a cylindrical stator 22, a rotor 23, and a rotating shaft 21. The stator 22 is set in the hermetic casing 10. The rotor 23 is rotatably installed in the stator 22. The rotating shaft 21 is installed to pass through a center of the rotor 23, and rotates along with the rotor 23 in a first direction, which is counterclockwise in the drawings, or in a second direction, which is clockwise in the drawings.

The compressing unit 30 includes a housing 33, upper and lower flanges 35 and 36, and a partition plate 34. The housing 33 defines upper and lower compression chambers 31 and 32, which are both cylindrical but have different capacities from each other, therein. The upper and lower flanges 35 and 36 are mounted to upper and lower ends of the housing 33, respectively, to rotatably support the rotating shaft 21. The partition plate 34 is interposed between the upper and lower compression chambers 31 and 32 to partition the upper and lower compression chambers 31 and 32 from each other.

The upper compression chamber 31 may be taller (i.e., may be higher in a vertical direction) than the lower compression chamber 32, thus the upper compression chamber 31 would have a larger capacity than the lower compression chamber 32. Therefore, a larger amount of gas is compressible in the upper compression chamber 31 in comparison with the lower compression chamber 32 to allow the variable capacity rotary compressor to have a variable capacity.

Further, an eccentric unit 40 is placed in the upper and lower compression chambers 31 and 32 to execute a compressing operation in either the upper or lower compression chamber 31 or 32, according to a rotating direction of the rotating shaft 21. A construction and operation of the eccentric unit 40 will be described later herein, with reference to FIGS. 2 to 7.

Upper and lower rollers 37 and 38 are placed in the upper and lower compression chambers 31 and 32, respectively, to be rotatably fitted over the eccentric unit 40. Upper inlet and upper outlet ports 63 and 65 (see FIG. 4) are formed at predetermined positions of the housing 33 to communicate with the upper compression chamber 31. Lower inlet and lower outlet ports 64 and 66 (see FIG. 6) are formed at predetermined positions of the housing 33 to communicate with the lower compression chamber 32.

Figure 4:
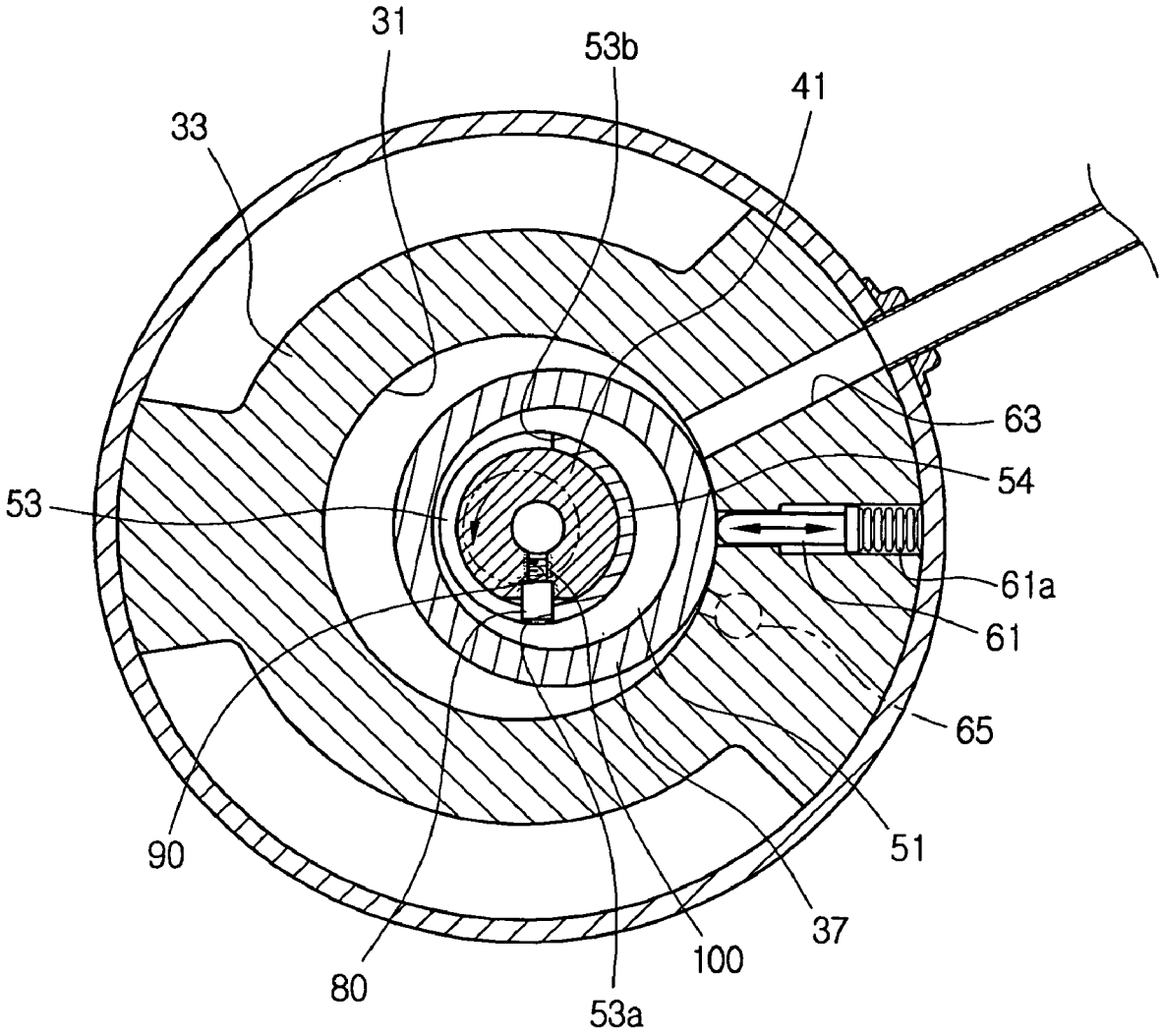
FIG. 4 is a sectional view illustrating an upper compression chamber in which a compression operation is executed by the eccentric unit of FIG. 2 when the rotating shaft rotates in a first direction.

An upper vane 61 is positioned between the upper inlet and upper outlet ports 63 and 65, and is biased in a radial direction by an upper support spring 61*a* to closely contact with the upper roller 37 (see FIG. 4). Further, a lower vane 62 is positioned between the lower inlet and lower outlet ports 64 and 66, and is biased in the radial direction by a lower support spring 62*a* to closely contact with the lower roller 38 (see FIG. 6).

Further, a refrigerant outlet pipe 69*a* extends from an accumulator 69 which contains a refrigerant therein. Of the refrigerant contained in the accumulator 69, only a gas refrigerant flows into the variable capacity rotary compressor through the refrigerant outlet pipe 69*a*. A path controller 70 is included at a predetermined position of the refrigerant outlet pipe 69*a*. The path controller 70 opens and closes upper or lower intake paths 67 or 68 to supply the gas refrigerant to the upper or lower inlet port 63 or 64 of the upper or lower compression chamber 31 or 32 in which a compression operation is executed. A valve 71 is installed in the path controller 70 to be movable in a horizontal direction. The valve 71 opens the upper or lower intake paths 67 or 68 by a difference in a pressure between the upper intake path 67 connected to the upper inlet port 63 and the lower intake path 68 connected to the lower inlet port 64 to supply the gas refrigerant to the upper inlet port 63 or lower inlet port 64.

A construction of the rotating shaft 21 and the eccentric unit 40 according to the embodiment of the present invention will be described in the following with reference to FIG. 2.

Figure 2:
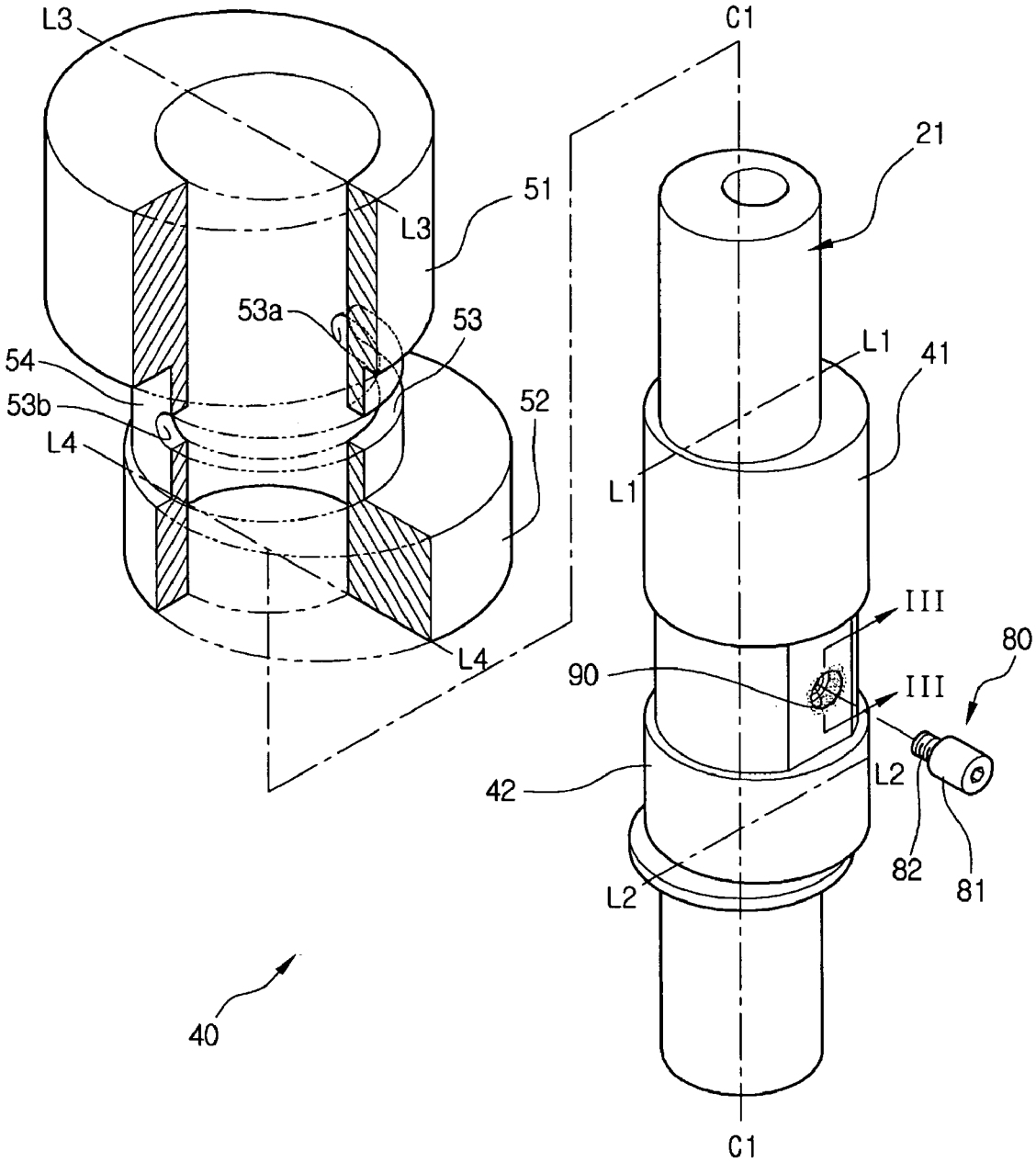
FIG. 2 is an exploded perspective view of an eccentric unit included in the variable capacity rotary compressor of FIG. 1, in which upper and lower eccentric bushes of the eccentric unit are separated from a rotating shaft.

FIG. 2 is an exploded perspective view of the eccentric unit 40 included in the variable capacity rotary compressor of FIG. 1, in which upper and lower eccentric bushes 51 and 52 of the eccentric unit 40 are separated from the rotating shaft 21. As illustrated in FIG. 2, the eccentric unit 40 includes upper and lower eccentric cams 41 and 42. The upper and lower eccentric cams 41 and 42 are provided on the rotating shaft 21 to be placed in the upper and lower compression chambers 31 and 32, respectively. Upper and lower eccentric bushes 51 and 52 are fitted over the upper and lower eccentric cams 41 and 42, respectively. A locking pin 80 is provided at a predetermined position between the upper and lower eccentric cams 41 and 42. A slot 53 of a predetermined length is provided at a predetermined position between the upper and lower eccentric bushes 51 and 52 to engage with the locking pin 80.

The upper and lower eccentric cams 41 and 42 are integrally fitted over the rotating shaft 21 to be eccentric from the central axis C1—C1 of the rotating shaft 21. The upper and lower eccentric cams 41 and 42 correspond in position to an upper eccentric line L1—L1 of the upper eccentric cam 41 to a lower eccentric line L2—L2 of the lower eccentric cam 42. In this case, the upper eccentric line L1—L1 is defined as a line to connect a maximum eccentric part of the upper eccentric cam 41, which maximally projects from the rotating shaft 21, to a minimum eccentric part of the upper eccentric cam 41, which minimally projects from the rotating shaft 21. Further, the lower eccentric line L2—L2 is defined as a line to connect a maximum eccentric part of the lower eccentric cam 42, which maximally projects from the rotating shaft 21, to a minimum eccentric part of the lower eccentric cam 42, which minimally projects from the rotating shaft 21.

The locking pin 80 includes a shank 82 having an external threaded part. A head 81 is formed at an end of the shank 82, and has a slightly larger diameter than the shank 82. Further, a locking hole 90 is provided at a position between the upper and lower eccentric cams 41 and 42 of the rotating shaft 21 so that the locking hole 90 is at about 90° with each of the upper and lower eccentric lines L1—L1 and L2—L2. The shank 82 of the locking pin 80 is inserted into the locking hole 90 through a screw-type fastening method. Thus, the locking pin 80 is fastened to the locking hole 90 while the head 81 of the locking pin 80 projects from the rotating shaft 21. A detailed construction of the locking hole 90 will be described later herein with reference to FIG. 3.

The upper and lower eccentric bushes 51 and 52 are integrated with each other by a connecting part 54 which connects the upper and lower eccentric bushes 51 and 52 to each other. The slot 53 is formed around a part of the connecting part 54, and has width which is slightly larger than a diameter of the head 81 of the locking pin 80.

Thus, when the upper and lower eccentric bushes 51 and 52 which are integrally connected to each other by the connecting part 54 are fitted over the rotating shaft 21 and the locking pin 80 is inserted to the locking hole 90 of the rotating shaft 21 through the slot 53, the locking pin 80 is mounted to the rotating shaft 21 while engaging with the slot 53.

When the rotating shaft 21 rotates in the first direction or the second direction in such a state, the upper and lower eccentric bushes 51 and 52 are not rotated until the locking pin 80 comes into contact with one of the first and second ends 53*a* and 53*b* of the slot 53. When the locking pin 80 contacts with the first or second end 53*a* or 53*b* of the slot 53, the upper and lower eccentric bushes 51 and 52 rotate in the first direction or the second direction along with the rotating shaft 21.

In this case, a first eccentric line L3—L3, which connects a maximum eccentric part of the upper eccentric bush 51 to a minimum eccentric part thereof, is placed at about 90° with a first line which connects the first end 53*a* of the slot 53 to a center of the connecting part 54. Further, a second eccentric line L4—L4, which connects a maximum eccentric part of the lower eccentric bush 52 to a minimum eccentric part thereof, is placed at about 90° with a second line which connects the second end 53*b* of the slot 53 to the center of the connecting part 54.

Further, the first eccentric line L3—L3 of the upper eccentric bush 51 and the second eccentric line L4—L4 of the lower eccentric bush 52 are positioned on a common plane, but the maximum eccentric part of the upper eccentric bush 51 is arranged to be opposite to the maximum eccentric part of the lower eccentric bush 52. An angle between a third line extending from the first end 53*a* of the slot 53 to a center of the rotating shaft 21 and a fourth line extending from the second end 53*b* of the slot 53 to the center of the rotating shaft 21 is 180°. The slot 53 is formed around a part of the connecting part 54.

Thus, when the locking pin 80 contacts the first end 53*a* of the slot 53 so that the upper eccentric bush 51 rotates along with the rotating shaft 21 in the first direction (the lower eccentric bush 52 is being rotated), the maximum eccentric part of the upper eccentric cam 41 aligns with the maximum eccentric part of the upper eccentric bush 51. At this time, the upper eccentric bush 51 rotates in the first direction while being maximally eccentric from the central axis C1—C1 of the rotating shaft 21 (see FIG. 4). Further, in the lower compression chamber 32, the maximum eccentric part of the lower eccentric cam 42 aligns with the minimum eccentric part of the lower eccentric bush 52. Thus, the lower eccentric bush 52 rotates in the first direction while being concentric with the central axis C1—C1 of the rotating shaft 21 (see FIG. 5).

Conversely, when the locking pin 80 contacts the second end 53*b* of the slot 53 so that the lower eccentric bush 52 rotates along with the rotating shaft 21 in the second direction, the maximum eccentric part of the lower eccentric cam 42 aligns with the maximum eccentric part of the lower eccentric bush 52. At this time, the lower eccentric bush 52 rotates in the second direction while being maximally eccentric from the central axis C1—C1 of the rotating shaft 21 (see FIG. 6). Further, in the upper compression chamber 31, the maximum eccentric part of the upper eccentric cam 41 aligns with the minimum eccentric part of the upper eccentric bush 51. Thus, the upper eccentric bush 51 rotates in the second direction while being concentric with the central axis C1—C1 of the rotating shaft 21 (see FIG. 7).

When the rotating shaft 21 rotates in the first direction or the second direction so that the locking pin 80 contacts with the first end 53*a* or the second end 53*b* of the slot 53, the locking pin 80 collides with the first end 53*a* or the second end 53*b* of the slot 53. Over time, the repetitive collisions of the locking pin 80 affect a surrounding of the locking hole 90 of the rotating shaft 21 cause abrasion of the surrounding of the locking hole 90. The abrasion of the surrounding of the locking hole 90 results in a gap being undesirably formed between the locking pin 80 and the locking hole 90. In this case, the locking pin 80 undesirably moves in the locking hole 90 and generates noise.

Further, as the surrounding of the locking hole 90 is worn out, the locking pin 80 carries out an undesired movement while the head 81 of the locking pin 80 is not secured in the locking hole 90. When the undesired movement of the locking pin 80 is repeated, the locking pin 80 may be broken or damaged. Therefore, the variable capacity rotary compressor of the present invention is constructed to solve the problem. The construction of the variable capacity rotary compressor will be described with reference to FIG. 3.

Figure 3:
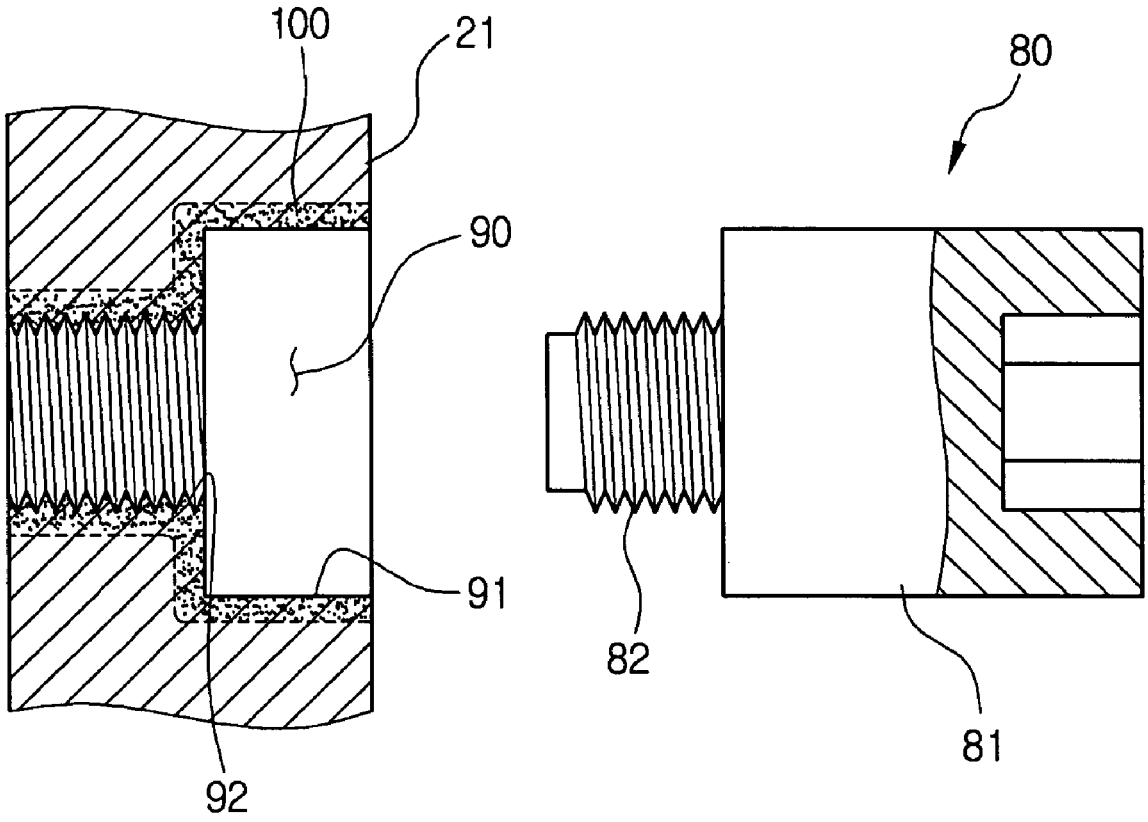
FIG. 3 is a sectional view taken along a line III—III of FIG. 2, in which a surface-treated part is provided around a locking hole to increase a hardness thereof.

FIG. 3 is a sectional view taken along a line III—III of FIG. 2. As shown in FIG. 3, the locking hole 90 includes a first diameter part 91, and a second diameter part 92. The first diameter part 91 is provided at an outer portion of the locking hole 90 to receive the head 81 of the locking pin 80. The second diameter part 92 is provided at an inner portion of the locking hole 90, and has an internal threaded part to correspond to the external threaded part of the shank 82 of the locking pin 80, so that the second diameter part 92 engages with the shank 82 through a screw-type fastening method.

The first diameter part 91 has a diameter to correspond to the head 81 of the locking pin 80, whereas the second diameter part 92 has a diameter to correspond to the shank 82 of the locking pin 80. In other words, the diameter of the first diameter part 91, which is provided at the outer portion of the locking hole 90, is larger than the diameter of the second diameter part 92, which is provided at the inner portion of the locking hole 90. In addition the first diameter part has a depth, which is smaller than the length of the head 81 of the locking pin 80, such that a portion of the head 81 protrudes from the locking hole 90.

Thus, when the locking pin 80 is inserted into the locking hole 90, and then is turned by a tool, such as a wrench, the shank 82 of the locking pin 80 engages with the second diameter part 92 of the locking hole 90 through the screw-type fastening method. The locking pin 80 is thus secured in the locking hole 90 and partially protrudes from the locking hole 90.

Further, a surface-treated part 100 is provided around the locking hole 90 so that the surrounding of the locking hole 90 has an increased hardness as compared to remaining parts of the rotating shaft 21 to prevent the surrounding of the locking hole 90 from being worn out due to impact generated when the locking pin 80 contacts with the first end 53*a* or the second end 53*b* of the slot 53.

The surface-treated part 100 has a size and a depth sufficient to surround the locking hole 90. After the rotating shaft 21 is manufactured, only the surrounding of the locking hole 90 which must have an increased hardness thereof is heat-treated or coated. Therefore, although the variable capacity rotary compressor of the present invention has been used for a lengthy period, the surrounding of the locking hole 90 is not substantially deformed or worn out.

A typical method of forming the surface-treated part 100 to use a high-frequency heat treatment which treats a surface of a component to increase a hardness thereof. Further, the surface-treated part 100 may be formed to have an increased hardness thereof as compared to remaining parts, through surface-treatment methods other than the high-frequency heat treatment.

The high-frequency heat treatment is suitable for a mass production of products, which are rapidly heated and are uniform. In other words, the high-frequency heat treatment may be used to harden a surface of a component to achieve high abrasion resistance, and enhance mechanical characteristics in a large number of products.

Since, the surface-treated part 100, having the increased hardness, is provided around the locking hole 90 when the variable capacity rotary compressor of the present invention has operated for a lengthy period and repetitively impacts surrounding of the locking hole 90, the surrounding of the locking hole 90 is not deformed or worn out, thus preventing the locking pin 80 from being broken or damaged.

The surface-treated part 100, which is provided through the high-frequency heat treatment, has a Rockwell Hardness of 20 or higher.

An operation of compressing a gas refrigerant in the upper or lower compression chamber 31 or 32 by the eccentric unit 40 according to the embodiment of the present invention will be described in the following with reference to FIGS. 4 to 7.

Figure 5:
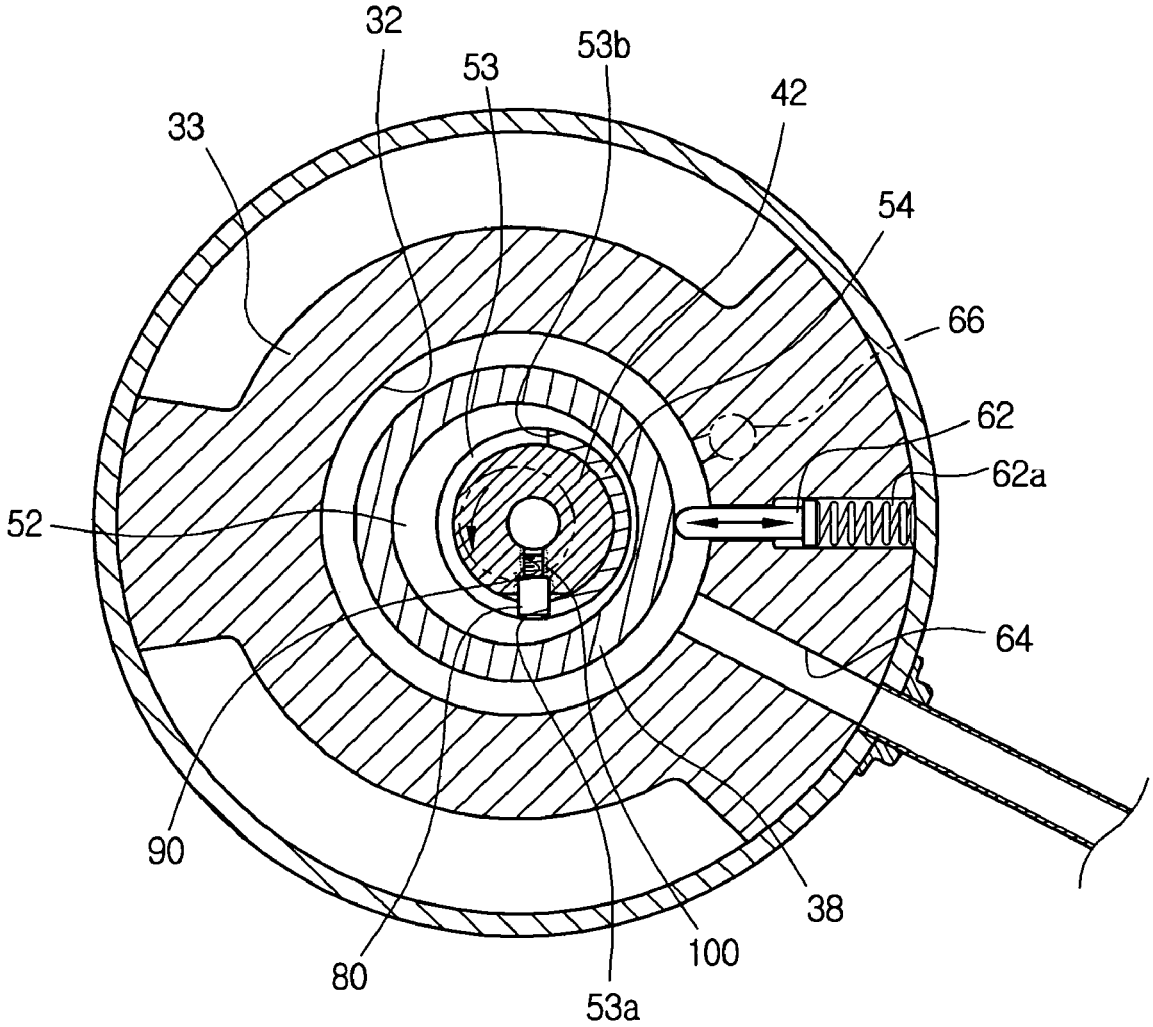
FIG. 5 is a sectional view, corresponding to FIG. 4, which shows a lower compression chamber in which an idle operation is executed by the eccentric unit of FIG. 2, when the rotating shaft rotates in the first direction.

FIG. 4 shows the upper compression chamber 31 in which the compression operation is executed by the eccentric unit 40, when the rotating shaft 21 rotates in the first direction, and FIG. 5 shows the lower compression chamber 32 in which the idle operation is executed by the eccentric unit 40, when the rotating shaft 21 rotates in the first direction.

As illustrated in FIG. 4, when the rotating shaft 21 rotates in the first direction which is counterclockwise in FIG. 4, the locking pin 80, projecting from the rotating shaft 21, rotates at a predetermined angle while engaging with the slot 53 which is provided at a predetermined position between the upper and lower eccentric bushes 51 and 52. When the locking pin 80 rotates at the predetermined angle, and is locked by the first end 53*a* of the slot 53, the upper eccentric bush 51 rotates along with the rotating shaft 21.

When the locking pin 80 contacts the first end 53*a* of the slot 53, the maximum eccentric part of the upper eccentric cam 41 aligns with the maximum eccentric part of the upper eccentric bush 51. In this case, the upper eccentric bush 51 rotates while being maximally eccentric from the central axis C1—C1 of the rotating shaft 21. Thus, the upper roller 37 rotates while being in contact with an inner surface of the housing 33 to define the upper compression chamber 31, thus executing the compressing operation.

Simultaneously, as illustrated in FIG. 5, the maximum eccentric part of the lower eccentric cam 42 contacts with the minimum eccentric part of the lower eccentric bush 52. In this case, the lower eccentric bush 52 rotates while being concentric with the central axis C1—C1 of the rotating shaft 21. Thus, the lower roller 38 rotates while being spaced apart from the inner surface of the housing 33, which defines the lower compression chamber 32, by a predetermined interval, thus the compressing operation is not executed and the lower compression chamber 32 otherwise executes the idle operation.

Therefore, when the rotating shaft 21 rotates in the first direction, the gas refrigerant flowing to the upper compression chamber 31 through the upper inlet port 63 is compressed by the upper roller 37 in the upper compression chamber 31 having a larger capacity, and subsequently is discharged from the upper compression chamber 31 through the upper outlet port 65. However, the compression operation is not executed in the lower compression chamber 32 having a smaller capacity. Therefore, the rotary compressor operates in a larger capacity compression mode.

Meanwhile, when the rotating shaft 21 rotates in the first direction so that the locking pin 80 inserted into the locking hole 90 contacts with the first end 53*a* of the slot 53, the locking pin 80 impacts on the surrounding of the locking hole 90. In a conventional rotary compressor, the repetitive impacts of the locking pin 80 would cause abrasion of the surrounding of the locking hole 90 to generate noise or to break and damage the locking pin 80.

The eccentric unit 40, according to the present invention, has an increased hardness, because the surface-treated part 100 is provided around the locking hole 90, as described above. Thus, although repetitive collisions of the locking pin 80 affect the surrounding of the locking hole 90 of the rotating shaft 21, the surrounding of the locking hole 90 is not deformed or not worn out. As a result, noise is not generated during the operation of the variable capacity rotary compressor, and the locking pin 80 is prevented from being broken or damaged.

Figure 6:
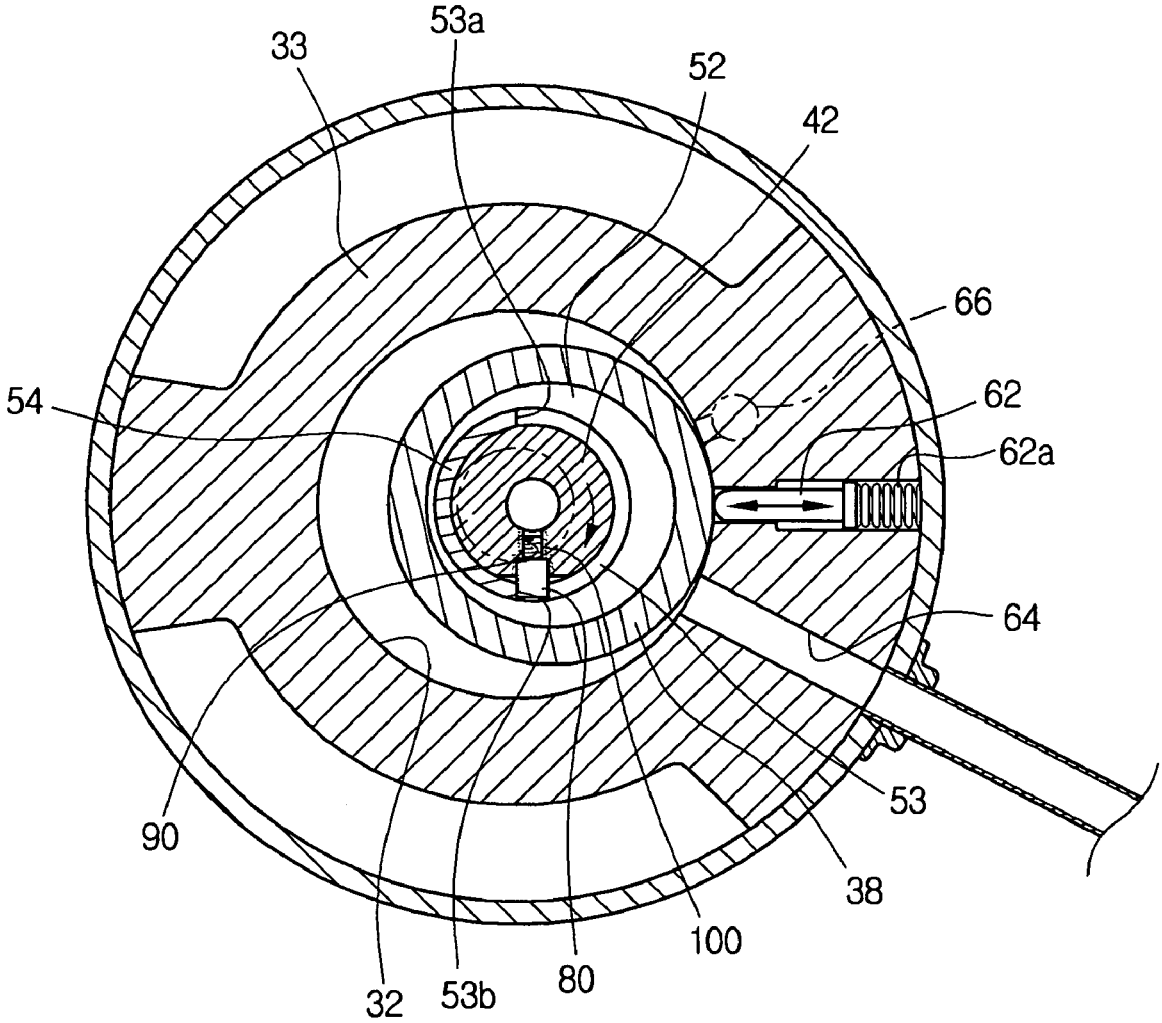
FIG. 6 is a sectional view illustrating the lower compression chamber in which the compression operation is executed by the eccentric unit of FIG. 2 when the rotating shaft rotates in a second direction.
Figure 7:
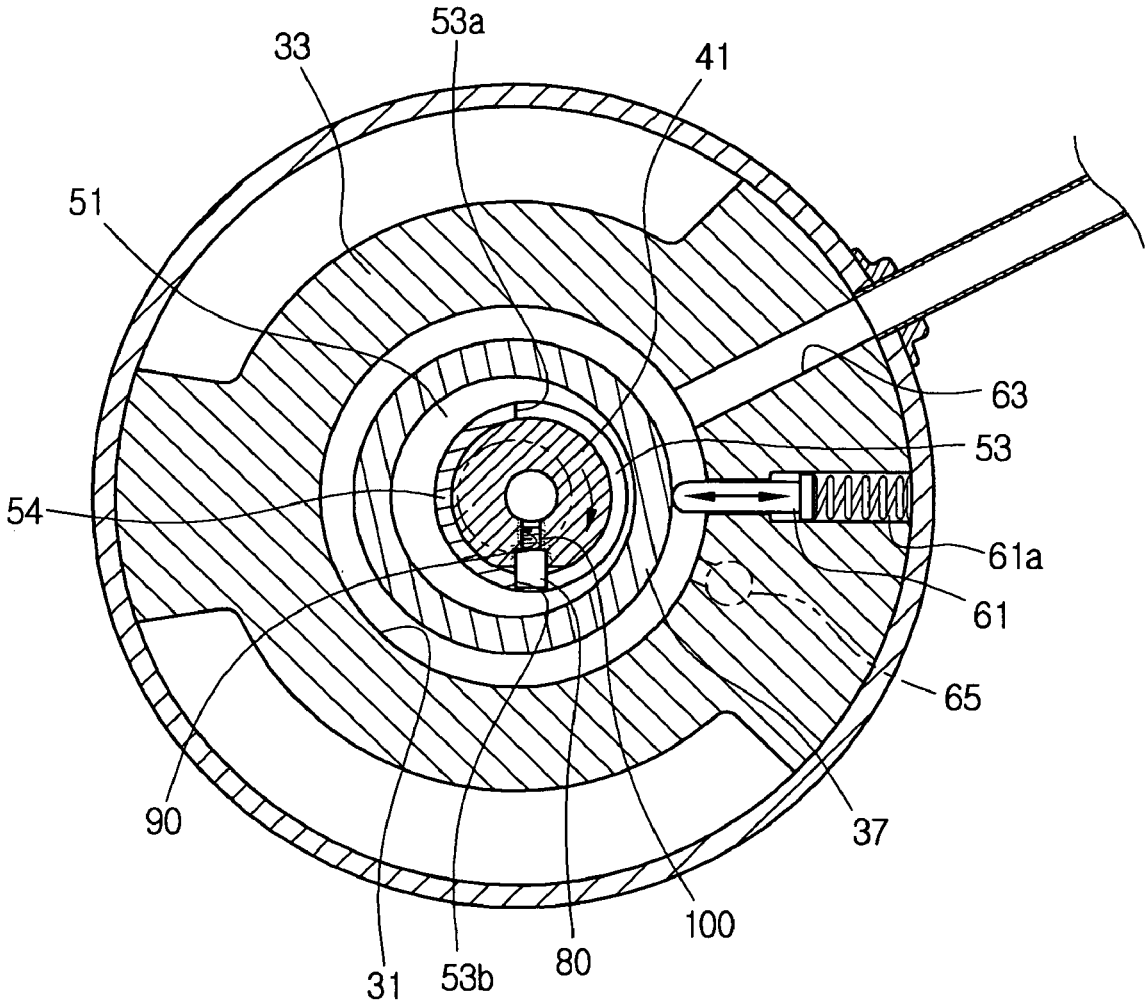
FIG. 7 is a sectional view, corresponding to FIG. 6, which shows the upper compression chamber in which the idle operation is executed by the eccentric unit of FIG. 2, when the rotating shaft rotates in the second direction.

FIG. 6 shows the lower compression chamber 32 in which the compression operation is executed by the eccentric unit 40, when the rotating shaft 21 rotates in the second direction, and FIG. 7 shows the upper compression chamber 31 in which the idle operation is executed by the eccentric unit 40, when the rotating shaft 21 rotates in the second direction.

As illustrated in FIG. 6, when the rotating shaft 21 rotates in the second direction, which is clockwise in FIG. 6, the variable capacity rotary compressor operates oppositely to the operation shown in FIGS. 4 and 5 to cause the compression operation to be executed in only the lower compression chamber 32.

That is, while the rotating shaft 21 rotates in the second direction, the locking pin 80 projecting from the rotating shaft 21 contacts with the second end 53*b* of the slot 53 to cause the lower and upper eccentric bushes 52 and 51 to rotate in the second direction.

In this case, the maximum eccentric part of the lower eccentric cam 42 contacts the maximum eccentric part of the lower eccentric bush 52, thus the lower eccentric bush 52 rotates while being maximally eccentric from the central axis C1—C1 of the rotating shaft 21. Therefore, the lower roller 38 rotates while being in contact with the inner surface of the housing 33 which defines the lower compression chamber 32, thus executing the compression operation.

Simultaneously, as illustrated in FIG. 7, the maximum eccentric part of the upper eccentric cam 41 contacts with the minimum eccentric part of the upper eccentric bush 51. In this case, the upper eccentric bush 51 rotates while being concentric with the central axis C1—C1 of the rotating shaft 21. Thus, the upper roller 37 rotates while being spaced apart from the inner surface of the housing 33, which defines the upper compression chamber 31, by a predetermined interval, thus the compressing operation is not executed and the upper compression chamber 31 otherwise executes the idle operation.

Therefore, the gas refrigerant flowing to the lower compression chamber 32 through the lower inlet port 64 is compressed by the lower roller 38 in the lower compression chamber 32 having a smaller capacity, and subsequently is discharged from the lower compression chamber 32 through the lower outlet port 66. However, the compression operation is not executed in the upper compression chamber 31 having a larger capacity. Therefore, the rotary compressor operates in a smaller capacity compression mode.

Meanwhile, when the rotating shaft 21 rotates in the second direction so that the locking pin 80 contacts with the second end 53*b* of the slot 53, the locking pin 80 impacts on the surrounding of the locking hole 90. Although in a conventional rotary compressor, the repetitive impacts of the locking pin 80 would cause abrasion of the surrounding of the locking hole 90 to generate noise or to break and damage the locking pin 80.

The eccentric unit 40, according to the present invention, has an increased hardness, because the surface-treated part 100 is provided around the locking hole 90, as described above. Thus, although repetitive collisions of the locking pin 80 affect the surrounding of the locking hole 90 of the rotating shaft 21, the surrounding of the locking hole 90 is not deformed or not worn out. As a result, noise is not generated during the operation of the variable capacity rotary compressor, and the locking pin 80 is prevented from being broken or damaged.

As is apparent from the above description, a variable capacity rotary compressor is provided, which is designed to execute a compression operation in either of upper and lower compression chambers having different interior capacities thereof by an eccentric unit which rotates in a first direction or a second direction, thus varying a compression capacity of the variable capacity rotary compressor as desired, therefore effectively cooling air around the variable capacity rotary compressor and saving energy.

Further, the present invention provides a variable capacity rotary compressor, which has a surface-treated part around a locking hole, thus having an increased hardness around the locking hole. Therefore, even when a locking pin collides with a first end or a second end of a slot by a rotation of an eccentric unit, and the collision affects on the surrounding of the locking hole, the surrounding of the locking hole is not deformed or not worn out, thus preventing noise from being generated, and preventing the locking pin from being broken or damaged.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A variable capacity rotary compressor, comprising:

upper and lower compression chambers having different interior capacities thereof;

a rotating shaft passing through the upper and lower compression chambers, with a locking hole being provided at a predetermined portion of the rotating shaft;

upper and lower eccentric cams provided on the rotating shaft;

upper and lower eccentric bushes fitted over the upper and lower eccentric cams, respectively;

a slot provided at a predetermined position between the upper and lower eccentric bushes;

a locking pin inserted into the locking hole to project from the rotating shaft, the locking pin operating to change a position of the upper or lower eccentric bush to a maximum eccentric position, in cooperation with the slot; and a surface-treated part provided around the locking hole to prevent the locking hole from being deformed or worn out when the locking pin collides with first and second ends of the slot.

2. The variable capacity rotary compressor according to claim 1, wherein the surface-treated part is provided through a high-frequency heat treatment.

3. The variable capacity rotary compressor according to claim 2, wherein the surface-treated part is fabricated to have a Rockwell Hardness of 20 or higher.

4. The variable capacity rotary compressor according to claim 1, wherein the locking pin comprises:

a threaded shank; and a head having a larger diameter than the threaded shank.

5. The variable capacity rotary compressor according to claim 4, wherein the locking hole comprises:

a first diameter part having a diameter to correspond to the head; and a second diameter part having a diameter to correspond to the threaded shank, and having a threaded part to engage with the threaded shank.

6. The variable capacity rotary compressor according to claim 1, wherein the locking hole is provided at a position between the upper and lower eccentric cams which are eccentric from the rotating shaft in a common direction, so that the locking hole is angularly spaced apart from a maximum eccentric part of each of the upper and lower eccentric cams at substantially 90°.

7. The variable capacity rotary compressor according to claim 1, further comprising:

a connecting part integrally connecting the upper and lower eccentric bushes, which are eccentric from the rotating shaft in opposite directions, to each other, wherein the locking pin projects from the rotating shaft between the upper and lower eccentric cams which are eccentric from the rotating shaft in a common direction, and the slot is formed around the connecting part to engage with the locking pin.

8. A variable capacity rotary compressor, comprising:

upper and lower compression chambers having different interior capacities thereof;

a rotating shaft having, at a predetermined portion thereof, a locking hole;

upper and lower eccentric cams provided on the rotating shaft to be placed in the upper and lower compression chambers, respectively;

upper and lower eccentric bushes fitted over the upper and lower eccentric cams, respectively;

a slot provided at a predetermined position between the upper and lower eccentric bushes, and having first and second ends;

a locking pin inserted into the locking hole, and moving in the slot so that one of the upper and lower eccentric bushes executes a compressing operation in an associated upper or lower compression chamber while a remaining one of the upper and lower eccentric bushes executes an idle operation in an associated upper or lower compression chamber; and a surface-treated part provided around the locking hole to prevent the locking hole from being deformed or worn out when the locking pin collides with the first and second ends of the slot.

9. The variable capacity rotary compressor according to claim 8, wherein the upper and lower eccentric bushes do not rotate until the locking pin comes into contact with either the first end or the second end of the slot, and the upper and lower eccentric bushes rotate in a first direction or a second direction when the locking pin comes into contact with either the first end or the second end of the slot.

10. The variable capacity rotary compressor according to claim 8, wherein the surface-treated part is provided through a high-frequency heat treatment.

11. The variable capacity rotary compressor according to claim 10, wherein the surface-treated part is fabricated to have a Rockwell Hardness of 20 or higher.

12. The variable capacity rotary compressor according to claim 8, wherein the locking pin comprises:

a threaded shank; and a head having a larger diameter than the threaded shank.

13. The variable capacity rotary compressor according to claim 12, wherein the locking hole comprises:

a first diameter part having a diameter to correspond to the head; and a second diameter part having a diameter to correspond to the threaded shank, and having a threaded part to engage with the threaded shank.

14. A variable capacity rotary compressor, comprising:

upper and lower compression chambers having different interior capacities thereof;

a rotating shaft having, at a predetermined portion thereof, a locking hole;

a slot having first and second ends;

a locking pin inserted into the locking hole of the rotating shaft to move between the first and second ends of the slot;

upper and lower eccentric bushes provided in the upper and lower compression chambers, respectively, one of the upper and lower eccentric bushes executing a compressing operation in an associated upper or lower compression chamber while a remaining one of the upper and lower eccentric bushes executing an idle operation in an associated upper or lower compression chamber, according to a position of the locking pin; and a surface-treated part provided around the locking hole to prevent the locking hole from being deformed or worn out when the locking pin collides with the first and second ends of the slot.

15. A variable capacity rotary compressor, including compression chambers having different interior capacities, a rotating shaft passing through the compression chambers, a locking hole in the rotating shaft, eccentric cams on the rotating shaft, eccentric bushes fitted over the eccentric cams, and a slot between the eccentric bushes, the compressor comprising:

a locking pin inserted into the locking hole to project from the rotating shaft, the locking pin changing a position of one of the eccentric bushes to a maximum eccentric position, in cooperation with the slot and in accordance with a rotating direction of the rotating shaft; and a surface-treated part to prevent the locking hole from being substantially deformed or worn out when the locking pin collides with first and second ends of the slot.

16. A variable capacity rotary compressor, including compression chambers having different interior capacities, a rotating shaft, a locking hole in the rotating shaft, eccentric cams on the rotating shaft to be placed in the compression chambers, eccentric bushes fitted over the eccentric cams, a slot having first and second ends between the eccentric bushes, the compressor comprising:

a locking pin inserted into the locking hole, to move in the slot so that one of the eccentric bushes executes a compressing operation in one of the compression chambers while a remaining one of the eccentric bushes executes an idle operation in a remaining one of the compression chambers; and a surface-treated part around the locking hole to prevent the locking hole from being substantially deformed or worn out when the locking pin collides with the first and second ends of the slot.

17. A variable capacity rotary compressor, having compression chambers having different interior capacities, a rotating shaft, a locking hole in the rotating shaft, a slot having first and second ends, a locking pin inserted into the locking hole to move between the first and second ends of the slot, the compressor comprising:

eccentric bushes in the compression chambers, one of the eccentric bushes executing a compressing operation in one of the compression chambers while a remaining one of the eccentric bushes executes an idle operation in a remaining one of the compression chambers, according to a position of the locking pin; and a surface-treated part around the locking hole to prevent the locking hole from being substantially deformed or worn out when the locking pin collides with the first and second ends of the slot.

* * * * *